US006273792B1

(12) United States Patent
Meloni

(10) Patent No.: US 6,273,792 B1
(45) Date of Patent: Aug. 14, 2001

(54) METHOD AND APPARATUS FOR IN-SITU MEASUREMENT OF WORKPIECE DISPLACEMENT DURING CHEMICAL MECHANICAL POLISHING

(75) Inventor: Mark Meloni, Tempe, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/372,270

(22) Filed: Aug. 11, 1999

(51) Int. Cl.[7] ..... B24B 1/00

(52) U.S. Cl. ..... 451/41; 451/5; 451/6; 451/8; 451/9; 451/60; 451/287

(58) Field of Search ..... 451/5, 6, 8, 9, 451/10, 41, 60, 287

(56) References Cited

U.S. PATENT DOCUMENTS 5,433,651 * 7/1995 Lustig et al. ..... 451/6
5,486,129 1/1996 Sandhu .
5,609,511 3/1997 Moriyama et al. .
5,899,792 5/1999 Yagi .
5,936,733 * 8/1999 Sandhu et al. ..... 356/357
6,106,662 * 8/2000 Bibby, Jr. et al. ..... 156/345

FOREIGN PATENT DOCUMENTS 0 824 995 A1 2/1998 (EP) .

* cited by examiner

*Primary Examiner*—Derris H. Banks
*Assistant Examiner*—Shantese McDonald
(74) *Attorney, Agent, or Firm*—Snell & Wilmer, LLP

(57) ABSTRACT

Method and apparatus for in-situ measurement of workpiece displacement during chemical mechanical polishing are disclosed. The chemical mechanical polishing apparatus includes a platen having a polishing material attached thereto and a distance measurement device attached to the platen. The distance measurement device includes a light source and a light sensor. Distance between the device and the workpiece is measured by transmitting light through apertures formed within the platen and the polishing material toward the workpiece and focusing the light reflected from the workpiece on an element within the sensor.

6 Claims, 4 Drawing Sheets

METHOD AND APPARATUS FOR IN-SITU MEASUREMENT OF WORKPIECE DISPLACEMENT DURING CHEMICAL MECHANICAL POLISHING

FIELD OF THE INVENTION

The present invention generally relates to chemical mechanical polishing. More particularly, the present invention relates to methods and apparatus for in-situ measurement of workpiece displacement during chemical mechanical polishing of a surface of the workpiece.

BACKGROUND OF THE INVENTION

Chemical mechanical polishing (CMP) is often used to remove material from a surface of a workpiece to provide a relatively smooth, flat surface on the workpiece. For example, CMP may be used in the formation of semiconductor devices and magnetic hard disks to provide a smooth, flat surface for subsequent processing of the devices or disks.

Material on a workpiece surface is removed using CMP by placing the workpiece surface in contact with a polishing surface and moving the workpiece and the polishing surface relative to each other. A slurry, including abrasive particles and/or chemicals that react with the material on the workpiece surface to dissolve the material, may also be placed in contact with the workpiece surface to assist removing a portion of the material.

During CMP processing, it is often desirable to remove a predetermined amount of material from the surface of the workpiece or leave a predetermined amount of material on the surface of the workpiece by removing excess material. Device or disk performance may vary in accordance with the thickness of a particular layer remaining on the surface of the workpiece. Thus, it is often desirable to mitigate variation of material removal or remaining material thickness across the workpiece surface to increase yield and/or performance of devices or disks, such that the remaining film thickness is near an optimal value across the surface of the workpiece.

Variation of material removal across a workpiece surface may be a function of several parameters or factors. For example, variation of material removal may be a function of, among other things, relative movement (e.g., direction and speed) between the workpiece and the polishing material, amount of slurry present at the workpiece surface, type of polishing material, material to be removed from the workpiece surface, tilt of a workpiece with respect to the polishing surface, pressure applied between the workpiece and the polishing surface, compression of the polishing material, and the number of workpieces cumulatively polished on a polishing material surface.

CMP modeling may be used to predict how various process parameters affect the variation of material removed across the workpiece surface. Modeling predictions may then be used to select polishing parameters to reduce variation of material removed across the surface of the workpiece, increase workpiece material removal rate, or a combination thereof. In addition, CMP modeling parameters may be used to predict how new materials (e.g., workpiece material, slurry material, polishing material, or any combination thereof) will affect material removal rates and variation of material removed from the workpiece surface.

Unfortunately, effects of various polishing parameters on workpiece material removal variation are not well understood, in part, because measurements of factors that affect material removal variation are difficult to obtain. For example, it is difficult to measure pad compression, wafer tilt, and other factors that affect material removal variation while polishing the workpiece.

An example of a CMP machine configured to measure effects of polishing parameters and use the measured effects to control a polishing process is disclosed in U.S. Pat. No. 5,868,896, issued to Robinson et al., on Feb. 9, 1999. The machine disclosed in the '896 patent includes a pressure sensor interposed between a workpiece and a carrier configured to guide the workpiece across a polishing surface. The pressure sensor generates a signal corresponding to the contour of the workpiece surface in contact with the polishing surface. The signal from the pressure senor is coupled to a controller, which in turn is coupled to an actuator on the carrier. To reduce variation in an amount of material removed from a wafer surface, the actuator increases or decreases pressure applied to portions of the wafer in response to the sensed pressure.

Although the CMP apparatus disclosed in the '896 patent discloses apparatus to measure pressure and adjust carrier force in response to the measured pressure, the apparatus does not provide for a mechanism to measure process parameters such as pad compression and wafer displacement. Accordingly, improved method and apparatus for measuring effects of various CMP polishing parameters are desired.

SUMMARY OF THE INVENTION

The present invention provides an improved method and apparatus for measuring chemical mechanical polishing (CMP) process characteristics that may affect polishing removal rate and removal rate variation across a surface of a workpiece. More particularly, the present invention provides a device for in-situ measurement of a distance between a surface of a workpiece and a fixed point on the CMP apparatus. The distance measurement may be used to correlate pad compression, wafer lift, wafer tilt, amount of slurry or other fluid(s) between the workpiece and a polishing surface, rate of polishing material removal during polishing material conditioning, or a combination of these factors to polishing removal rates and removal rate variation across the surface of the workpiece.

The way in which the present invention addresses the drawbacks of the now-known CMP machines is addressed in greater detail hereinbelow. However, in general, the improved machine includes a device to measure distance between a reference point and a workpiece surface during CMP. The distance measurement may facilitate an understanding of the CMP process and modeling of the process. In addition, polishing material compression and wear may be determined by measuring the distance between the workpiece and the polishing material. Effects of pad compression may then be correlated to workpiece material removal rate and removal rate variability.

In accordance with an exemplary embodiment of the present invention, a laser displacement sensor is mounted to a CMP machine. The sensor is configured to measure a distance between the sensor and a surface of the workpiece. In accordance with one aspect of this embodiment, apertures are formed within a polishing material and a platen attached to the polishing material. Light from the sensor is illuminated in a direction through the apertures, toward the workpiece, and reflected from the workpiece surface to the sensor. In accordance with an exemplary aspect of this embodiment, confocal measuring techniques are used to measure the distance between the sensor and the workpiece.

BRIEF DESCRIPTION OF THE DRAWINGS

A more complete understanding of the present invention may be derived by referring to the detailed description and claims, considered in connection with the figures, wherein like reference numbers refer to similar elements throughout the figures, and:

DETAILED DESCRIPTION OF EXEMPLARY EMBODIMENTS

The present invention generally relates to a method and apparatus for polishing workpieces, and more particularly to a chemical mechanical polishing (CMP) machine configured to obtain measurements useful in understanding and modeling CMP processes and methods for obtaining the measurements. Although the present invention may be used to polish a variety of workpieces such as computer disks, optical disks and the like, the present invention is conveniently described below in connection with polishing semiconductor wafers.

Figure 1:
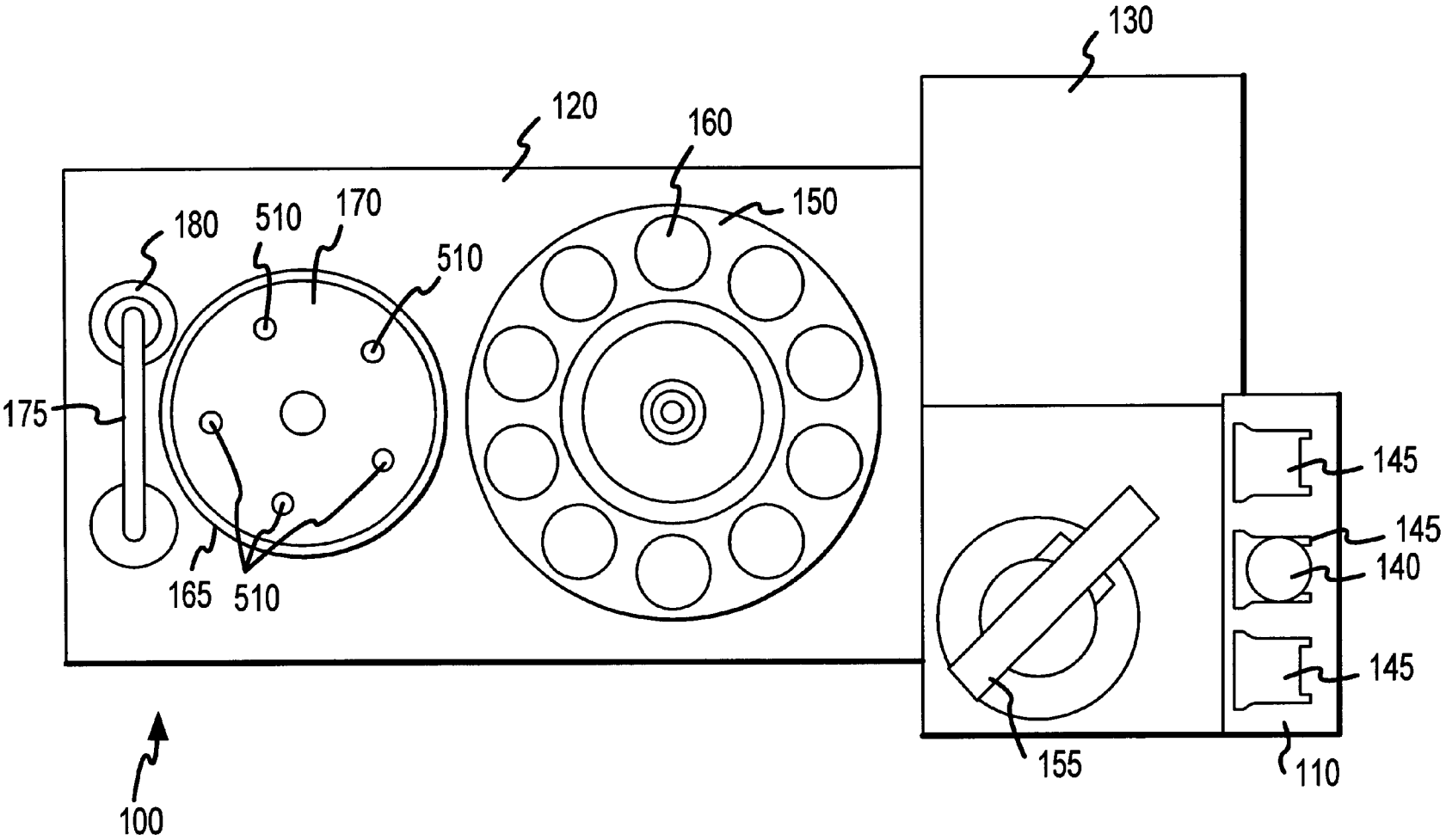
FIG. 1 illustrates a cross-sectional view of a chemical mechanical polishing apparatus having a distance measurement device in accordance with the present invention.

FIG. 1 illustrates a chemical mechanical polishing machine 100 in accordance with an exemplary embodiment of the present invention. Although polishing machine 100 may include any apparatus suitable for removing material from a workpiece surface (e.g., a web polisher, a linear polisher, an orbital polisher, or a lapping machine) machine 100 is preferably rotary CMP machine such as a model Auriga machine manufactured by Speedfam-IPEC, Inc. of Chandler, Ariz. Polishing machine 100 suitably includes a wafer load and unload station 110, polishing module 120, and a cleaning station 130.

Machine 100 is configured to remove a desired amount of material from one or more surfaces of a workpiece such as a wafer 140. As explained in more detail below, in accordance with an exemplary embodiment of the present invention, machine 100 removes dry wafer 140 from a cassette 145, polishes, cleans, rinses, and dries wafer 140, and returns wafer 140 to cassette 145 at load and unload station 110.

In operation, one or more wafers 140 are loaded onto machine 100 at station 110. Wafers 140 are then transported to an indexing station 150 located within polishing module 120 using a robot 155. At indexing station 150, wafers 140 are loaded (e.g., from a load/unload cup 160 at station 150) into a polishing carrier 270 (shown in FIG. 2), and are transported to a polishing station 165 for polishing.

At station 165, material is removed from a surface of wafer 140 by moving the surface relative to a polishing material 170; such polishing often occurs in the presence of deionized water, a slurry composition, a chemical configured to etch and/or oxidize material on the wafer surface, or a combination thereof. After wafers 140 are polished, wafers 140 are transported back to indexing station 150 (e.g., to load/unload cup 160). From indexing station 150, wafers 140 are transferred to cleaning station 130. At station 130, residual slurry material and/or other debris on the wafer surface is removed and wafer 140 is suitably dried and subsequently returned to cassette 145.

In addition to wafer processing, machine 100 is configured to condition polishing material 170 using a conditioner 175. Polishing material 170 is conditioned by moving a conditioning element 180 over a surface of material 170. Such movement may include rotation of material 170, rotation of element 180, translation of conditioner 175 over material 170, or any combination thereof. Conditioning of material 170 may affect the resiliency of material 170, the compressibility of material 170, the thickness of material 170, and an amount of slurry contained in material 170. Consequently, conditioning of material 170 may affect material removal rates and material removal variation across wafer 140 surface.

Figure 2:
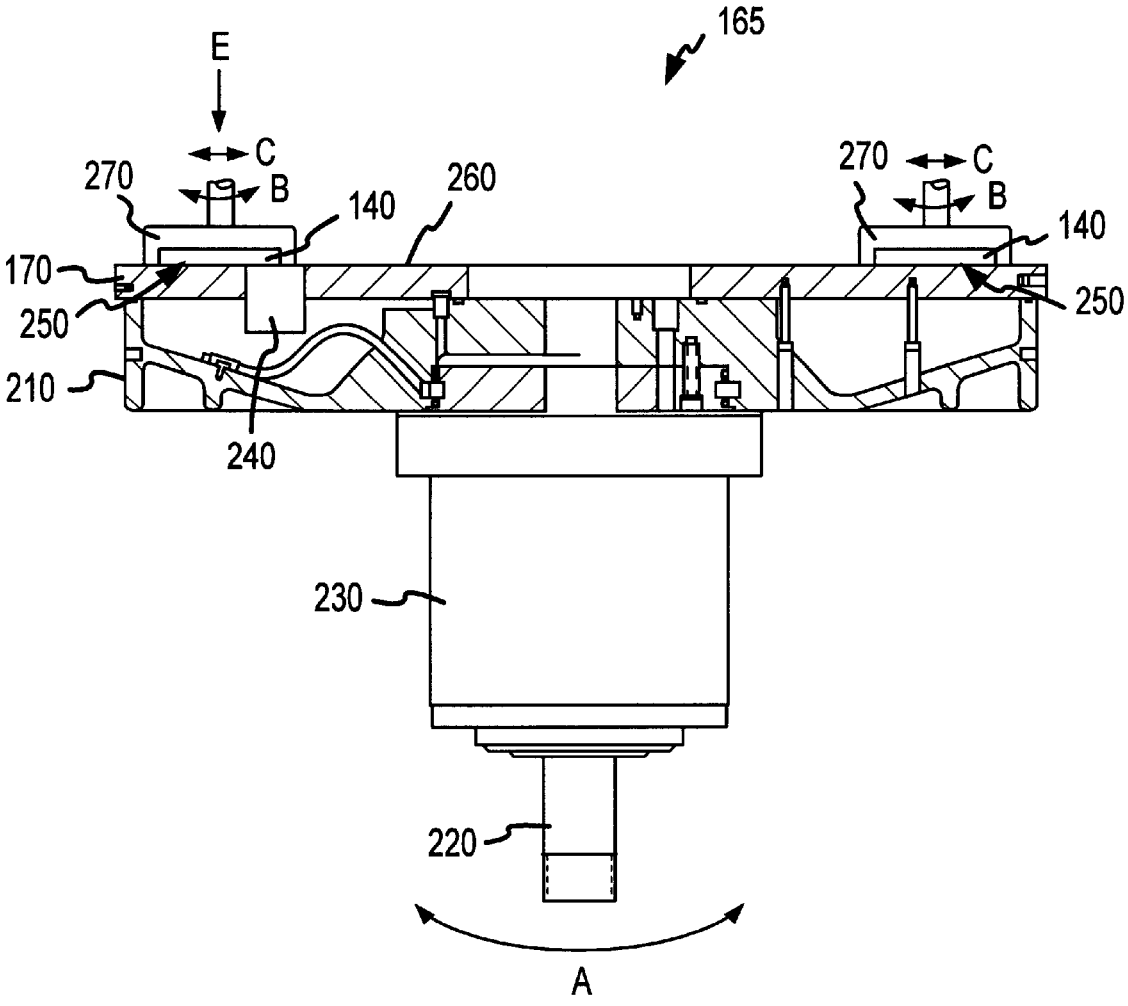
FIG. 2 is a cross-sectional illustration of a portion of a polishing station in accordance with the present invention.

FIG. 2 illustrates a portion of a polishing station 165 in greater detail. Station 165 suitably includes polishing material 170, a platen 210, a shaft 220, a coupling assembly 230, and a distance sensor 240.

Station 165 is configured to facilitate removal of material from a lower surface 250 of wafer 140. In accordance with an exemplary embodiment of the present invention, material is removed from surface 250 by pressing surface 250 against a surface 260 of polishing material 170, and moving wafer surface 250 relative to polishing surface 260 while at least a portion of surface 250 is in contact with at least a portion of surface 260. To move wafer surface 250 relative to polishing surface 260, polishing material 170 may rotate in the direction indicated by arrow A, wafer 140 may rotate in a direction indicated by arrow B, wafer 140 may translate across surface 260 as indicated by arrow C, or any combination of rotation and translation movements may be combined.

Carrier 270 is employed to urge wafer 140 against surface 260 (e.g., in a direction indicated by arrow E) and to move wafer 140 in the directions indicated by arrows B and C. In addition, carrier 270 is suitably configured to move wafer 140 between polishing station 165 and indexing station 150 during workpiece processing.

Polishing material 170 is generally attached to or integral with platen 210 such that material 170 moves as platen 210 moves. Material 170 may include any material that facilitates removal of matter from wafer surface 250. For example, polishing material 170 may include a polishing pad formed of resilient material such as polyurethane or a fixed abrasive, relatively rigid material. As discussed in greater detail below, material 170 may also suitably include apertures or transparent material to accommodate distance measurements between device 240 and surface 250. Alternatively, polishing material 170 may not include apertures if material 170 is transparent to light or other media used by device 240 to measure distance.

Figure 3:
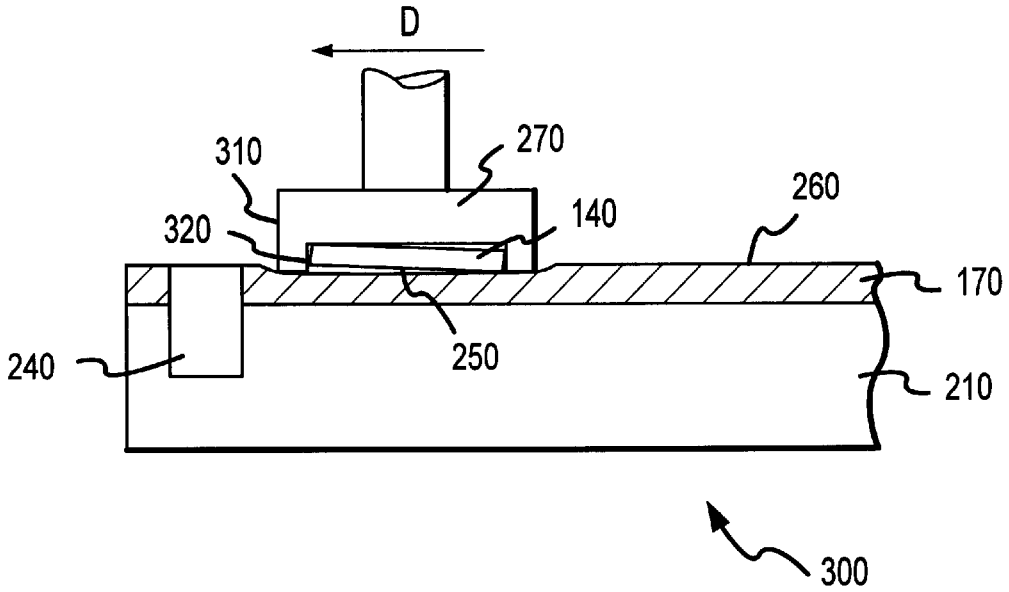
FIG. 3 is a close-up, cross-sectional illustration of a portion of the polishing station shown in FIG. 2 in accordance with the present invention.

As wafer surface 250 moves relative to polishing surface 260 during polishing, wafer surface 250 may tilt and polishing material 170 may compress. FIG. 3 illustrates a portion 300 of polishing station 165, showing wafer 140 tilt and polishing material 170 compression in accordance with an exemplary embodiment of the present invention. As illustrated, when carrier 270 and wafer 140 move in a direction indicated by arrow D, a leading edge 310 of carrier 270 initially compresses polishing material 170. Also, a leading edge 320 of wafer 140 may initially elevate relative to polishing material 170. Material 170 compression, wafer 140 tilt, or a combination thereof may contribute to variation of material removal rates across surface 250 of wafer 140. For example, material 170 compression and wafer 140 tilt may contribute to an increased material removal rate at an outer diameter of wafer 140. Accordingly, it may be desirable to measure an amount of pad compression and wafer tilt as wafer 140 traverses polishing surface 260 and correlate the distance measurement to process conditions to determine the cause of tilt and compression and to mitigate the effects (e.g., variability of material removal) resulting from the tilt and compression. In addition, polishing material 170 wear may contribute to variation in material removal across surface 250. Thus, it is desirable to measure a distance between surface 250 and sensor 240 to measure material 170 wear, and to correlate material wear to material removal rate and removal rate variation across surface 250.

In accordance with an exemplary embodiment of the present invention, a process condition is varied, and wafer distance measurements are taken as wafer 140 traverses material 170 prior to and after the process condition is varied to measure the effects of the process change on wafer tilt and/or material 170 compression. For example, wafer 140 rotation speed, in the direction indicated by arrow B in FIG. 2, may be varied, and the effects of wafer 140 rotation speed on material 170 compression and wafer tilt may be monitored by measuring the distance between sensor 240 and various points on wafer surface 250. Similarly, effects of platen 210 rotation speed, wafer 140 translation speed, slurry flow rate, pressure applied to wafer 140, material 170 wear and conditioning, and the like may be monitored in accordance with the present invention. The monitored distance, which may include slurry thickness and/or polishing material thickness, measurements may be used to control or model the CMP process.

Wafer 140 displacement may also be correlated to removal rates of various materials from a surface of wafer 140; this information may be used for in-situ polishing process control. In accordance with an exemplary embodiment of the present invention, a wafer polishing process is selected with predetermined process parameters such as wafer rotation speed, platen rotation speed, slurry flow rate, and the like. Wafer 140 is then polished with the selected process, while displacement measurement information is collected. After polishing is complete, material removal rate and material removal uniformity across wafer 140 may be measured using typical film thickness measurement apparatus. Next, to obtain information to correlate wafer displacement to material removal rates and material removal variation, one or more process parameters is set to a second predetermined value, wafer 140 is polished, and removal rate and variation information is collected. Material removal rate and material removal rate variation is then correlated to wafer displacement information. The wafer displacement information, which is measured in real time as wafer 140 is polished, may now be used to predict material removal rate and removal rate variation, and to control a polishing process by adjusting one or more process parameters in response to a measured wafer displacement. In accordance with this embodiment, sensor 240 may function as a diagnostic tool and/or a control tool to regulate a polishing process—e.g, to optimize material removal rates and removal rate variation across a surface 250 of wafer 140.

Wafer 140 tilt, which may be an important factor that causes variation in material removal across surface 250, may be calculated by measuring a first distance between a fixed point and first point on wafer 140, measuring a distance between the fixed point (or a second fixed point) and a second point on wafer 140, and comparing the distances. For example, wafer 140 tilt may be measured by simultaneously measuring the distance between a first point on wafer 140 and a first sensor 240, measuring a second point on water 140 and a second sensor 240, subtracting the second distance from the first distance to obtain a height difference, and dividing the height difference by the distance between first sensor 240 and second sensor 240. In addition, this height-to-distance ratio information may be collected over time to determine wafer tilt with time to observe real time polishing dynamics. Accordingly, as noted below, in accordance with an exemplary embodiment of the present invention, two or more sensors 240 are located within an area defined by surface 250.

Distance sensor 240 is configured to measure a distance from sensor 240 to a point on wafer surface 250 as wafer 140 traverses over material 170. In accordance with an exemplary embodiment of the present invention, at least one distance sensor 240 is mounted to platen 210. However, in accordance with alternative embodiments of the present invention, multiple sensors 240 are mounted to platen 210 to facilitate additional wafer displacement measurements. In accordance with one exemplary embodiment of the present invention, two or more sensors are attached to platen 210 such that the distance between the two sensors 240 is less than or equal to a diameter of wafer 140. This allows monitoring of differential displacement between two points on wafer 140 as noted above.

Sensor 240 may be mounted to platen 210 in a variety of ways. However, in accordance with the present invention, sensor 240 is embodied in a plastic package with built-in mounting fixtures, and sensor 240 is mounted in an aperture or cavity formed within platen 210. In accordance with alternative embodiments of the present invention, if machine 100 includes a linear, web-based or similar apparatus, sensor 240 is suitably mounted to an air-bearing platen or other structure located opposite a polishing surface of the workpiece.

To provide power to sensor 240 and enable signals from sensor 240 to travel to a control processing unit (which may be attached to or integral with machine 100), platen 210 is suitably configured with electronic signal transfer apparatus such as an electrical rotary union, an RF or IR transfer apparatus, or the like. In accordance with one exemplary embodiment of the invention, power is supplied via a battery to sensor 240.

Distance measurement device or sensor 240 may include any apparatus capable of measuring a distance between two points. However, in accordance with an exemplary embodiment of the present invention, sensor 240 includes a laser sensor such as a laser confocal displacement meter, Model LT-8010, manufactured by Kayence Corporation of America.

Figure 4:
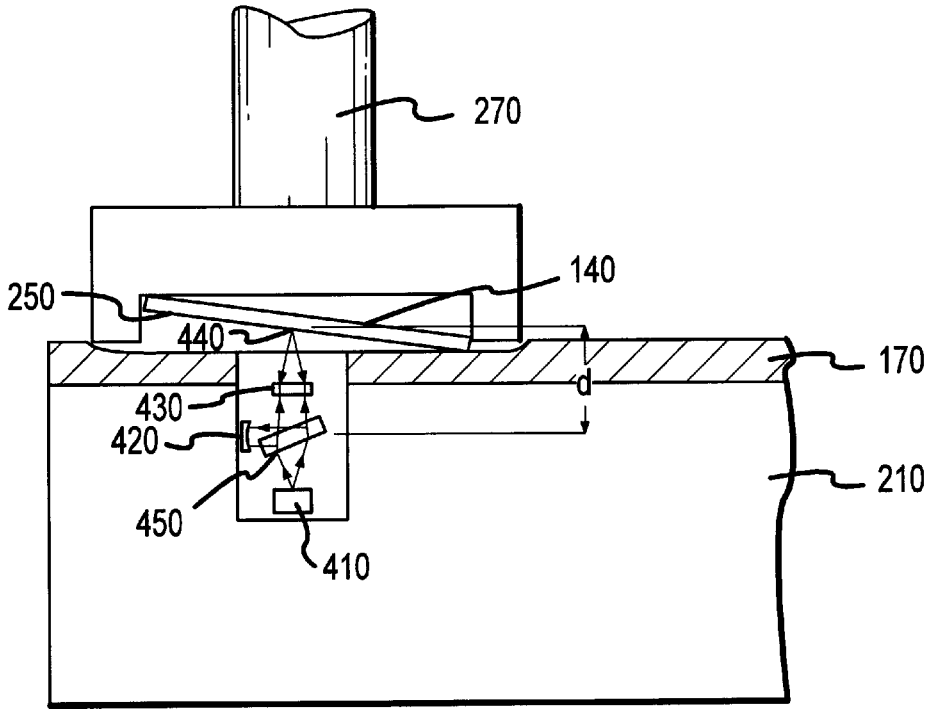
FIG. 4 illustrates a cross-sectional view of the polishing station of FIG. 2, showing exaggerated polishing material compression and wafer tilt.

FIG. 4 represents wafer tilt and material 170 compression is exaggerated form to illustrate distance measurement between sensor 240 and a point on wafer 140 in accordance with the present invention. In accordance with an with an exemplary embodiment of the present invention, sensor 240 includes a light source 410, a light receiving element 420, and a lens 430. Sensor 240 is suitably configured to measure a distance (d) between receiving element 420 and a point 440 on wafer 140 using confocal techniques. Distance (d) is measured by emitting a light source from source 410 toward wafer surface 250, through lens 430 that vibrates rabidly by (e.g. means of a tuning fork); reflecting the light off surface 250 to a half mirror 450 that directs the reflected light to element 420. The distance measurement (d) is obtained by determining lens 430 position when the reflected light focuses on element 420.

Figure 5:
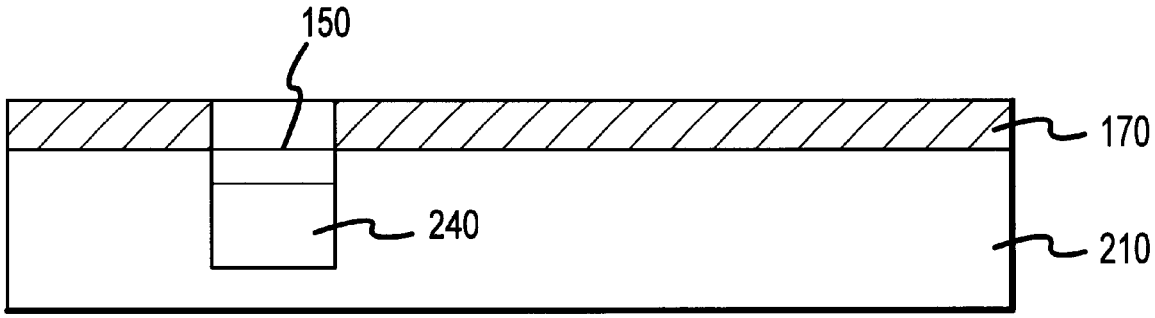
FIG. 5 illustrates a cross-sectional view of a polishing platen having an aperture formed therein.

To facilitate laser or other forms of distance measurement, platen 210 and polishing material 170 include apertures or transparent material 510 that is transparent to the type of laser or other media used for measurement, as illustrated in FIGS. 1 and 5. However, in an alternative embodiment of the present invention, entire polishing material 170, platen 210, or any combination thereof may be transparent to the laser source. In this case, the transparent material (polishing material and/or platen) need not include apertures or additional transparent material for the laser transmission.

In accordance with an exemplary embodiment of the present invention, material 510 in either platen 210 and/or material 170 is formed of any material capable of transmitting at least a portion of the laser beam emanating from sensor 240. In addition, material 510 is preferably configured to reduce or prevent slurry, polishing debris and other material resident on polishing material surface 260 from reaching laser source 410, element 420, and/or sensor 240.

Although the present invention is set forth herein in the context of the appended drawing figures, it should be appreciated that the invention is not limited to the specific form shown. For example, while the apparatus for measuring a distance between a portion of a CMP machine and a wafer is conveniently described as including a laser source and a laser sensor, other apparatus using electron beam, x-ray, or other techniques may be used to measure a distance between a portion of the CMP machine and the wafer. Various other modifications, variations, and enhancements in the design and arrangement of the method and apparatus set forth herein, may be made without departing from the spirit and scope of the present invention as set forth in the appended claims.

I claim:

1. A chemical mechanical polishing apparatus configured to collect workpiece displacement information while processing the workpiece, said apparatus comprising:

a chemical mechanical polishing machine; and a distance measuring device attached to a portion of said chemical mechanical polishing machine, said device configured to transmit light toward the workpiece to measure a distance between a point on the workpiece and said device.

2. The chemical mechanical polishing apparatus according to claim 1, further comprising a platen fixedly attached to said chemical mechanical polishing machine, said platen having an aperture configured to transmit light.

3. The chemical mechanical polishing apparatus according to claim 2, further comprising a polishing material attached to said platen.

4. The chemical mechanical polishing apparatus according to claim 3, wherein at least a portion of said polishing material is transparent to light.

5. The chemical mechanical polishing apparatus according to claim 2, wherein said distance measurement device is mounted into a cavity is said platen.

6. The chemical mechanical polishing apparatus according to claim 5, further comprising a rotary union coupled to said platen, said rotary union configured to transmit data from said distance measurement device to a central processing unit.

* * * * *